US012075963B2

(12) United States Patent
Ohm et al.

(10) Patent No.: US 12,075,963 B2
(45) Date of Patent: Sep. 3, 2024

(54) MOBILE CLEANING ROBOT WITH SKIDS

(71) Applicant: iRobot Corporation, Bedford, MA (US)

(72) Inventors: Timothy R. Ohm, Grover Beach, CA (US); Erik Amaral, Bolton, MA (US); Andrew Deschenes, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 17/388,314

(22) Filed: Jul. 29, 2021

(65) Prior Publication Data

US 2023/0036749 A1 Feb. 2, 2023

(51) Int. Cl.
*A47L 9/06* (2006.01)
*A46B 9/02* (2006.01)
(Continued)

(52) U.S. Cl.
CPC ..... *A47L 9/0606* (2013.01); *A46B 9/02* (2013.01); *A46B 9/12* (2013.01); *A46B 13/008* (2013.01);
(Continued)

(58) Field of Classification Search
CPC ..... A47L 11/10; A47L 11/24; A47L 11/28; A47L 11/32; A47L 9/0606; A47L 9/009; A47L 9/0472; A47L 9/0488; A47L 9/066; A47L 9/2852; A47L 2201/00; A47L 2201/04; A46B 9/08; A46B 9/10; A46B 9/12; A46B 9/02; A46B 13/008; A46B 13/02; A46B 2200/3033; E01H 1/02; E01H 1/04; E01H 1/05; E01H 1/053;
(Continued)

(56) References Cited

U.S. PATENT DOCUMENTS 2,241,775 A 5/1941 Albert
4,198,727 A * 4/1980 Farmer ..... A47L 9/06 15/396
(Continued)

FOREIGN PATENT DOCUMENTS

CN 112842165 A * 5/2021 ..... A47L 11/293
DE 102015105228 A1 * 10/2016 ..... A47L 9/06
(Continued)

OTHER PUBLICATIONS

PE2E Translation of CN-112842165-A; Zou, J; May 28, 2021; p. 1-30 (Year: 2021).*
(Continued)

*Primary Examiner* — Brian D Keller
*Assistant Examiner* — Sidney D Full
(74) *Attorney, Agent, or Firm* — Schwegman Lundberg & Woessner, P.A.

(57) ABSTRACT

A mobile cleaning robot can include a body, a drive wheel, and a plurality of skids. The drive wheel can be connected to the body and can be engageable with a floor surface of an environment. The drive wheel can be operable to move the mobile cleaning robot about an environment. The skids can be separate skids that can be connected to the body and can be engageable with the floor surface to support, together with the drive wheel, the mobile cleaning robot with respect to the floor surface.

23 Claims, 6 Drawing Sheets

(51) Int. Cl.

| | |
|---|---|
| ***A46B 9/12*** | (2006.01) |
| ***A46B 13/00*** | (2006.01) |
| ***A46B 13/02*** | (2006.01) |
| ***A47L 9/00*** | (2006.01) |
| ***A47L 9/04*** | (2006.01) |
| ***A47L 9/28*** | (2006.01) |

(52) U.S. Cl.
CPC ..... *A46B 13/02* (2013.01); *A47L 9/009* (2013.01); *A47L 9/0472* (2013.01); *A47L 9/0488* (2013.01); *A47L 9/066* (2013.01); *A47L 9/2852* (2013.01); *A46B 2200/3033* (2013.01); *A47L 2201/04* (2013.01)

(58) Field of Classification Search
CPC ..... E01H 1/056; B62B 13/02; B62B 13/06; B62B 17/02; B60S 9/04; B62D 55/04; B62D 49/08
See application file for complete search history.

(56) References Cited

U.S. PATENT DOCUMENTS

| | | | | |
|---|---|---|---|---|
| 6,094,776 | A * | 8/2000 | Fish | A47L 9/062 15/364 |
| 8,726,454 | B2 | 5/2014 | Gilbert, Jr. et al. | |
| 10,947,685 | B1 * | 3/2021 | Hirshberg | A47L 11/4013 |
| 2004/0148732 | A1 | 8/2004 | Allard-Latour et al. | |
| 2013/0340201 | A1 * | 12/2013 | Jang | A47L 9/009 15/300.1 |
| 2015/0150364 | A1 * | 6/2015 | Gafford | A46D 1/0207 15/186 |
| 2016/0297276 | A1 * | 10/2016 | Jeong | B60G 17/0195 |
| 2018/0177368 | A1 * | 6/2018 | Acker | A47L 9/0072 |
| 2018/0325252 | A1 * | 11/2018 | Hopke | A47L 7/02 |

FOREIGN PATENT DOCUMENTS

| | | | | |
|---|---|---|---|---|
| DE | 102018120544 | | 2/2020 | |
| EP | 0163772 | | 12/1985 | |
| EP | 3838098 | | 6/2021 | |
| EP | 3482669 | B1 * | 9/2022 | A47L 11/4005 |
| JP | 2013230199 | A * | 11/2013 | |
| WO | WO-2020037517 | A1 * | 2/2020 | |
| WO | 2023009300 | | 2/2023 | |

OTHER PUBLICATIONS

PE2E Translation of WO-2020037517-A1; Li, B; Feb. 7, 2020; p. 1-22 (Year: 2020).*
PE2E Translation DE-102015105228-A1; Diesch, D; Device for a Suction Fan Having a Cleaning Device; Aug. 22, 2019 (Year: 2019).*
EP 3482669 WIPO Translation; Isenberg, Gerhard; Wet Cleaning Device for Cleaning a Surface (Year: 2017).*
WIPO Translate JP-2013230199; Yoshida, Choji; Suction Port Body, Suction Tool and Self-Traveling Robot; Nov. 14, 2013 (Year: 2013).*
"New! SpinWave® Wet and Dry Robotic Vacuum", https://www.bissell.com/products/spinwave-wet-and-dry-robotic-vacuum.html, (2021), 8 pgs.
"International Application Serial No. PCT US2022 036637, International Search Report mailed Nov. 9, 2022", 5 pgs.
"International Application Serial No. PCT US2022 036637, Written Opinion mailed Nov. 9, 2022", 7 pgs.
"Chinese Application Serial No. 202221973271.1, Office Action mailed Dec. 19, 2022", w Concise Statement of Relevance, 3 pgs.
"Chinese Application Serial No. 202221973247.8, Office Action mailed Dec. 19, 2022", w Concise Statement of Relevance, 3 pgs.
"Chinese Application Serial No. 202221973272.6, Office Action mailed Dec. 19, 2022", w Concise Statement of Relevance, 3 pgs.
"International Application Serial No. PCT/US2022/036637, International Preliminary Report on Patentability mailed Feb. 8, 2024", 9 pgs.

* cited by examiner

MOBILE CLEANING ROBOT WITH SKIDS

BACKGROUND

Autonomous mobile robots include autonomous mobile cleaning robots that can autonomously perform cleaning tasks within an environment, such as a home. An autonomous cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which can engage the debris and guide the debris toward a vacuum airflow generated by the robot. The rotatable members and the vacuum airflow can thereby cooperate to allow the robot to ingest debris.

BRIEF DESCRIPTION OF THE DRAWINGS

The patent or application file CONTAINS AT LEAST ONE DRAWING EXECUTED IN COLOR. Copies of this patent or patent application publication with color drawings) will be provided by the Office upon request and payment of the necessary fee.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Autonomous mobile cleaning robots can be useful to automatically or autonomously clean a portion, such as a room or rooms, of an environment by extracting debris off a surface of the room or rooms. Extraction can be performed using a pair of rollers that can rotate in opposite directions, which can help to improve debris extraction and cleaning performance. The use of a single fixed roller with a dustpan can allow for a roller design that can help to reduce an amount of energy required during cleaning operations. This roller arrangement can use a cleaning head that does not move with respect to a body of the robot, which requires tolerances that may be required to be tighter than can be provided by drive wheels.

This disclosure describes devices and methods that can help to address this problem such as by allowing the drive wheels to move freely with respect to the body of the robot, which can eliminate the drive wheels from the tolerance stack relevant to the cleaning head, and can help to improve robot mobility by reducing a variance in the load carried by the drive wheels as the robot travels between flooring types. However, in allowing the drive wheels to move with respect to the sled or body of the robot, the drive wheels no longer define a ride height of the robot's body, meaning another component must do so. Use of a single caster (a common practice) is no longer useful to define the ride height as a single wheel cannot properly support the body of the robot. This disclosure discusses use of a plurality (e.g., 3) skids to support a bottom portion or sled of the robot to register the sled and therefore the cleaning head to the floor surface. The skids can allow the fixed cleaning head to engage the floor surface for cleaning effectiveness on various surface types while allowing the drive wheels to move as necessary with respect to the body for improved mobility on various surface types.

The above discussion is intended to provide an overview of subject matter of the present patent application. It is not intended to provide an exclusive or exhaustive explanation of the invention. The description below is included to provide further information about the present patent application.

Figure 1A:
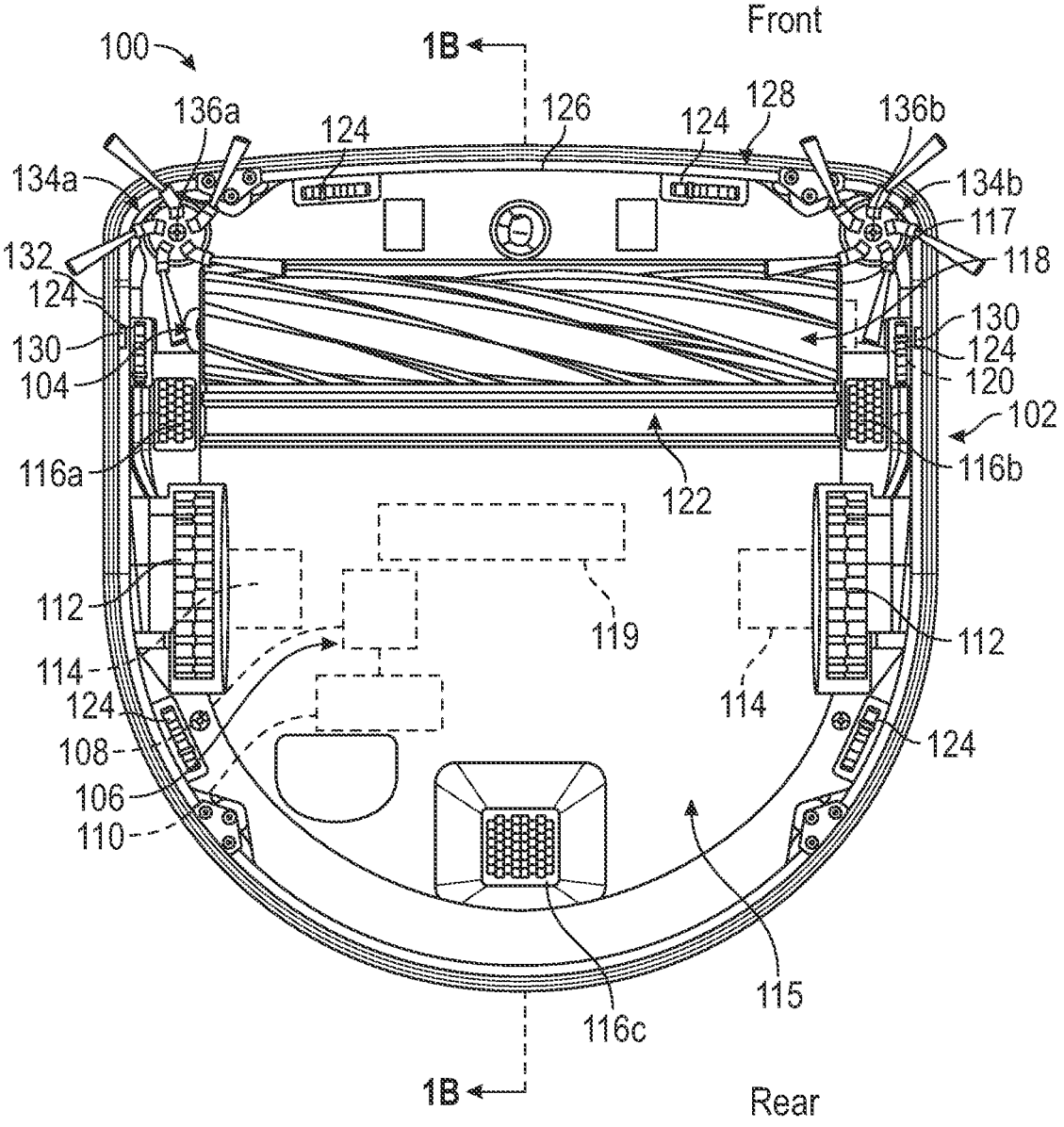
FIG. 1A illustrates a bottom view of a mobile cleaning robot.
Figure 1B:
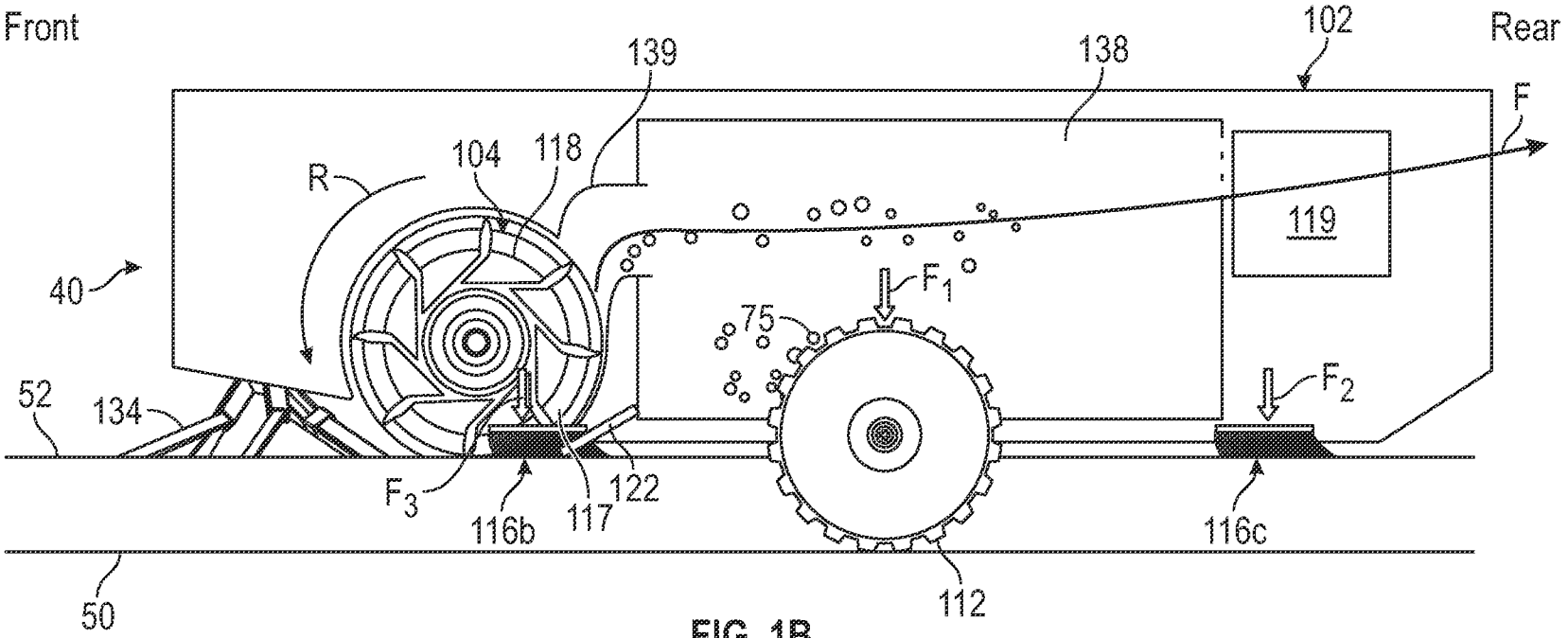
FIG. 1B illustrates a cross-sectional view of a mobile cleaning robot.

FIG. 1A illustrates a bottom view of a mobile cleaning robot 100. FIG. 1B illustrates a cross-sectional view of the mobile cleaning robot 100 in an environment 40. FIGS. 1A and 1B are discussed together below. FIG. 1A shows section indicators 1B-1B and FIGS. 1A-1C also shows orientation indicators Front and Rear.

The cleaning robot 100 can include a housing or body 102, a cleaning assembly 104, a control system 106 (which can include a controller 108 and memory 110). The cleaning robot 100 can also include drive wheels 112, motor(s) 114, and a bottom skid 115 including support skid or skids 116*a*, 116*b*, and 116*c* (collectively referred to as skids 116). The cleaning assembly 104 can include a cleaning inlet 117 a roller 118 (or cleaning wheel), a vacuum system 119, a roller motor 120, and a dustpan 122 (or guide). The robot 100 can also include cliff sensors 124, proximity sensors 126, a bumper 128, bump sensors 130, an obstacle following sensor 132, a side brush 134*a* including a motor 136*a*, and a side brush 134*b* including a motor 136*b*. The side brushes 134*a* and 134*b* can be referred to as the side brushes 134.

The housing 102 can be a rigid or semi-rigid structure comprised of materials such as one or more of metals, plastics, foams, elastomers, ceramics, composites, combinations thereof, or the like. The housing 102 can be configured to support various components of the robot 100, such as the wheels 112, the controller 108, the cleaning assembly 104, the dustpan 122, and the side brushes 134. The housing 102 can define the structural periphery of the robot 100. In some examples, the housing 102 includes a chassis, cover, the bottom plate 115, and bumper assembly. Because the robot 100 can be a household robot, the robot 100 can have a small profile so that the robot 100 can fit under furniture within a home. The cleaning assembly 104 can be in a fixed position with respect to the body or housing 102 of the robot 100. The roller 118 of the cleaning assembly 104 can be rotatably connected to the housing 102 near the cleaning inlet 117 (optionally located in a forward portion of the robot 100), where the roller 118 can extend horizontally across the robot 100. The roller 118 can be connected to the roller motor 120 to be driven to rotate the roller 118 relative to the housing 102 to help collect dirt and debris from the environment 40 through the cleaning inlet 117. The vacuum system 119 can include a fan or impeller and a motor operable by the controller 108 to control the fan to generate airflow through the cleaning inlet 117 between the roller 118 and into a debris bin 138 (shown in FIG. 1B).

The roller 118 can be of several types, such as when the roller 118 is optimized based on the environment 40, as discussed further below. The roller 118 can include bristles or brushes, which can be effective at separating (or agitating) debris within carpet fibers for suction by the robot 100. The roller 118 can also include vanes, fletches, or flexible members extending therefrom, which can be relatively effective at separating debris within carpet fibers for suction by the robot 100 while also being effective at pulling debris off hard surfaces. The roller 118 can also include no fins, vanes, or bristles, which can be effective at pulling debris off hard surfaces. The roller 118 can be other types of roller in other examples.

The controller 108 can be located within the housing and can be a programmable controller, such as a single or multi-board computer, a direct digital controller (DDC), a programmable logic controller (PLC), or the like. In other examples the controller 108 can be any computing device, such as a handheld computer, for example, a smart phone, a tablet, a laptop, a desktop computer, or any other computing device including a processor, memory, and communication capabilities. The memory 110 cam be one or more types of memory, such as volatile or non-volatile memory, read-only memory (ROM), random-access memory (RAM), magnetic disk storage media, optical storage media, flash-memory devices, and other storage devices and media. The memory 110 can be located within the housing 102, connected to the controller 108 and accessible by the controller 108.

The control system 106 can further include a sensor system with one or more electrical sensors, for example. The sensor system, as described herein, can generate a signal indicative of a current location of the robot 100, and can generate signals indicative of locations of the robot 100 as the robot 100 travels along the floor surface 50. The controller 108 can also be configured to execute instructions to perform one or more operations as described herein.

The drive wheels 112 can be supported by the housing 102 of the robot 100, can be partially within the housing 102, and can extend through the bottom portion of the housing 102. The wheels 112 can also be connected to and rotatable with a shaft; the wheels 112 can be configured to be driven by the motors 114 to propel the robot 100 along the surface 50 of the environment 40, where the motors 114 can in communication with the controller 108 to control such movement of the robot 100 in the environment 40. The drive wheels 112 can be configured to move, such as vertically, with respect to the skid plate 115, allowing the drive wheels 112 to carry a relatively high load of the robot 100, such as 60%, 65%, 70%, 75%, 80%, 85%, or the like of the weight (or load) of the robot 100, and can help to carry a relatively consistent load of the robot, which can help to improve robot navigation, especially over medium and high pile carpeting.

The skids 116 can be low friction elements connected to the body 102 of the robot and can each be a passive body configured to help balance the robot 100 on the floor surface 52. Together, the drive wheels 112 and the skid(s) 116 can cooperate to support the housing 102 above the floor surface 50. For example, the skid 116*c* can be located in a rearward portion of the housing 102, and the drive wheels 112 can be located forward of the skid 116*c*. The skids 116*a*-116*c* can include a plurality of tufts of bristles, as discussed in further detail below, such that the skids are configured to slide or skid along the floor surface (50 or 52) without rotating (such as end-over-end as with a wheel). The bristles can help to reduce pressure applied by individual bristles, helping to limit damage done to the floor surface by the skids 116 or debris engaged with one or more of the skids 116.

The skids 116*a*, 116*b*, and 116*c* can each be connected to the body 102 and can be separated from each other. The skids 116 can be engageable with the floor surface 52 to support, together with the drive wheels 112, the mobile cleaning robot with respect to the floor surface 52. Three of the skids 116 can be used to provide registration of the skid plate 115 to the floor surface 52. More or fewer skids 116 can optionally be used, such as 1, 2, 4, 5, 6, 7, 8, 9, 10, or the like.

By supporting the robot 100 from the floor surface 52, the skids 116 can define the ride height of the robot 100. For example, as shown in FIG. 1 the drive wheel or wheels 112 can support a load F1, the skid 116*c* can support the force F2, and the skid 116*a* can support the load or force F3. The skid 116*b* can support a force F4. The force F1 supported by the drive wheels can be between 65 and 85 percent of the weight of the robot 100. The forces F2, F3, and F4 can each be between 5 and 15 percent of the weight of the robot 100. Optionally, the forces F2, F3, and F4 can each be between 1 and 25 percent of the weight of the robot 100.

The skids 116*a* and 116*b* can be located at or near opposing sides of the cleaning assembly 104, such as near opposing sides of the roller 118. For example, the skid 116*c* can be located near a rear portion of the skid plate 115. The skid 116*a* can be located rearward of the side brush 134*a* and can be located laterally outward of the cleaning head 104. The skid 116*b* can be located rearward of the side brush 134*b* and can be located laterally outward of the cleaning head 104. Locating the skids 116*a* and 116*b* rearward of the side brushes 134*a* and 134*b*, respectively, can help to limit engagement between the skids 116*a* and 116*b* and debris. Locating the skids 116*a* and 116*b* near a front end of the skid plate and the skid 116*c* near a rear portion of the skid plate 115 with the skid 116*c* near a center of the skid plate and the skids 116*a* and 116*b* near lateral sides of the skid plate can help to improve stability of the robot 100.

As shown in FIG. 1B, the skids 116 can together define a ride height of the robot through engagement with an upper floor surface 52, where the drive wheels 112 can move with respect to the skids and the floor surface 52, allowing the drive wheels 112 to extend to a lower floor surface 50. This engagement can allow the drive wheels to engage solid terrain for producing movement relative to the floor surfaces 50 and 52, while engagement between the skids 116 and the upper floor surface 52 can register the skid plate 115 and therefore the cleaning system 104 with the upper floor surface 52 for effective and efficient cleaning.

The dustpan 122 can be connected to the body 102 and can be engageable with the floor surface 50 (as shown in FIG. 1B) to help direct debris 5 from the environment 40 to the suction duct 139 for collection in the collection bin 138. The roller 118 can also be engageable with the dustpan 122 to direct debris 75 to the suction duct 139. The dustpan 122 can be actively or passively retractable to help improve mobility of the robot 100.

The cliff sensors 124 can be located along a bottom portion of the housing 102. Each of the cliff sensors 124 can be an optical sensor that can be configured to detect a presence or absence of an object below the optical sensor, such as the floor surface 50. The cliff sensors 124 can be connected to the controller 108. The proximity sensor(s) 126 can be located near a forward portion of the housing 102. In other examples, the proximity sensors 126 can be located on other portions of the housing 102. The proximity sensor 126 can include an optical sensor facing outward from the housing 102 and can be configured produce a signal based on a presence or the absence of an object in front of the optical sensor. The proximity sensor 126 can be connected to the controller.

The bumper 128 can be removably secured to the housing 102 and can be movable relative to housing 102 while mounted thereto. In some examples, the bumper 128 can form part of the housing 102. The bump sensors 130 can be connected to the housing 102 and engageable or configured to interact with the bumper 128. The bump sensors 130 can include break beam sensors, capacitive sensors, switches, or other sensors that can detect contact between the robot 100, i.e., the bumper 128, and objects in the environment 40. The bump sensors 130 can be connected to the controller 108.

The robot can optionally include an image capture device that can be a camera connected to the housing 102. The image capture device can be configured to generate a signal based on imagery of the environment 40 of the robot 100 as the robot 100 moves about the floor surface 50.

The obstacle following sensors 132 can include an optical sensor facing outward from the side surface of the housing 102 and that can be configured to detect the presence or the absence of an object adjacent to the side surface of the housing 102. The obstacle following sensor 132 can emit an optical beam horizontally in a direction perpendicular to the forward drive direction F of the robot 100. In some examples, at least some of the proximity sensor 126 and the obstacle following sensor 132 can include an optical emitter and an optical detector. The optical emitter can emit an optical beam outward from the robot 100, e.g., outward in a horizontal direction, and the optical detector detects a reflection of the optical beam that reflects off an object near the robot 100. The robot 100, e.g., using the controller 108, can determine a reflected intensity (or optionally a time of flight of the optical beam) and can thereby determine a distance between the optical detector and the object, and hence a distance between the robot 100 and the object.

The side brushes 134 can be connected to an underside of the robot 100 and can be connected to the motors 136, which can be operable to rotate the side brushes 134 with respect to the housing 102 of the robot 100. The side brushes 134 can be configured to engage debris to move the debris toward the cleaning assembly 104 or away from edges of the environment 40. The motors 136 can be configured to drive the side brushes 134 and can be in communication with the controller 108.

In operation of some examples, the robot 100 can be propelled in a forward drive direction or a rearward drive direction. The robot 100 can also be propelled such that the robot 100 turns in place or turns while moving in the forward drive direction or the rearward drive direction.

The controller 108 can execute software stored on the memory 110 to cause the robot 100 to perform various navigational and cleaning behaviors by operating the various motors of the robot 100. For example, when the controller 108 causes the robot 100 to perform a mission, the controller 108 can operate the motors 114 to drive the drive wheels 112 and propel the robot 100 along the floor surface 50, In addition, the controller 108 can operate the motor 120 to cause the roller 118 to rotate, can operate the motors 136 to cause the brushes 134 to rotate, and can operate the motor of the vacuum system 119 to generate airflow.

The roller 118 can be rotatable about an axis (shown in FIG. 1B) to contact the floor surface 50 to agitate debris 75 on the floor surface 50 as the rotatable member 118 rotate relative to the housing 102. The rotatable member 118 agitates debris 75 on the floor surface to direct the debris 75 from the cleaning inlet 117, toward a suction duct 139 (shown in FIG. 1B), and into the debris bin 138 within the robot 100. The vacuum system 119 can cooperate with the cleaning assembly 104 to draw debris 75 from the floor surface 50 into the debris bin 138, In some cases, airflow generated by the vacuum system 119 can create sufficient force to draw debris 75 on the floor surface 50 upward through the suction duct 139 and into the debris bin 138. The side brushes 134 can be rotatable about the non-horizontal axis in a manner that brushes debris on the floor surface 50 into a cleaning path of the cleaning assembly 104 as the robot 100 moves.

The various sensors of the robot 100 can be used to help the robot navigate and clean within the environment 40. For example, the cliff sensors 124 can detect obstacles such as drop-offs and cliffs below portions of the robot 100 where the cliff sensors 124 are disposed. The cliff sensors 124 can transmit signals to the controller 108 so that the controller 108 can redirect the robot 100 based on signals from the cliff sensors 124. The proximity sensors 126 can produce a signal based on a presence or the absence of an object in front of the optical sensor. For example, detectable objects include obstacles such as furniture, walls, persons, and other objects in the environment 40 of the robot 100. The proximity sensor 126 can transmit signals to the controller 108 so that the controller 108 can redirect the robot 100 based on signals from the proximity sensors 126.

In some examples, the bump sensor 130 can be used to detect movement of the bumper 128 of the robot 100. The bump sensors 130 can transmit signals to the controller 108 so that the controller 108 can redirect the robot 100 based on signals from the bump sensors 130. In some examples, the obstacle following sensors 132 can detect detectable objects, including obstacles such as furniture, walls, persons, and other objects in the environment of the robot 100. In some implementations, the sensor system can include an obstacle following sensor along the side surface, and the obstacle following sensor can detect the presence or the absence an object adjacent to the side surface. The one or more obstacle following sensors 132 can also serve as obstacle detection sensors, similar to the proximity sensors described herein.

The robot 100 can also include sensors for tracking a distance travelled by the robot 100. For example, the sensor system can include encoders associated with the motors 114 for the drive wheels 112, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 108 can use data collected by the sensors of the sensor system to control navigational behaviors of the robot 100 during the mission. For example, the controller 108 can use the sensor data collected by obstacle detection sensors of the robot 100, (the cliff sensors 124, the proximity sensors 126, and the bump sensors 130) to enable the robot 100 to avoid obstacles within the environment of the robot 100 during the mission.

The sensor data can also be used by the controller 108 for simultaneous localization and mapping (SLAM) techniques in which the controller 108 extracts features of the environment represented by the sensor data and constructs a map of the floor surface 50 of the environment. The sensor data collected by the image capture device can be used for techniques such as vision-based SLAM (VSLAM) in which the controller 108 extracts visual features corresponding to objects in the environment 40 and constructs the map using these visual features. As the controller 108 directs the robot 100 about the floor surface 50 during the mission, the controller 108 can use SLAM techniques to determine a location of the robot 100 within the map by detecting features represented in collected sensor data and comparing the features to previously stored features. The map formed from the sensor data can indicate locations of traversable and nontraversable space within the environment. For example, locations of obstacles can be indicated on the map as nontraversable space, and locations of open floor space can be indicated on the map as traversable space.

The sensor data collected by any of the sensors can be stored in the memory 110. In addition, other data generated for the SLAM techniques, including mapping data forming the map, can be stored in the memory 110. These data produced during the mission can include persistent data that are produced during the mission and that are usable during further missions. In addition to storing the software for causing the robot 100 to perform its behaviors, the memory 110 can store data resulting from processing of the sensor data for access by the controller 108. For example, the map can be a map that is usable and updateable by the controller 108 of the robot 100 from one mission to another mission to navigate the robot 100 about the floor surface 50.

Figure 1C:
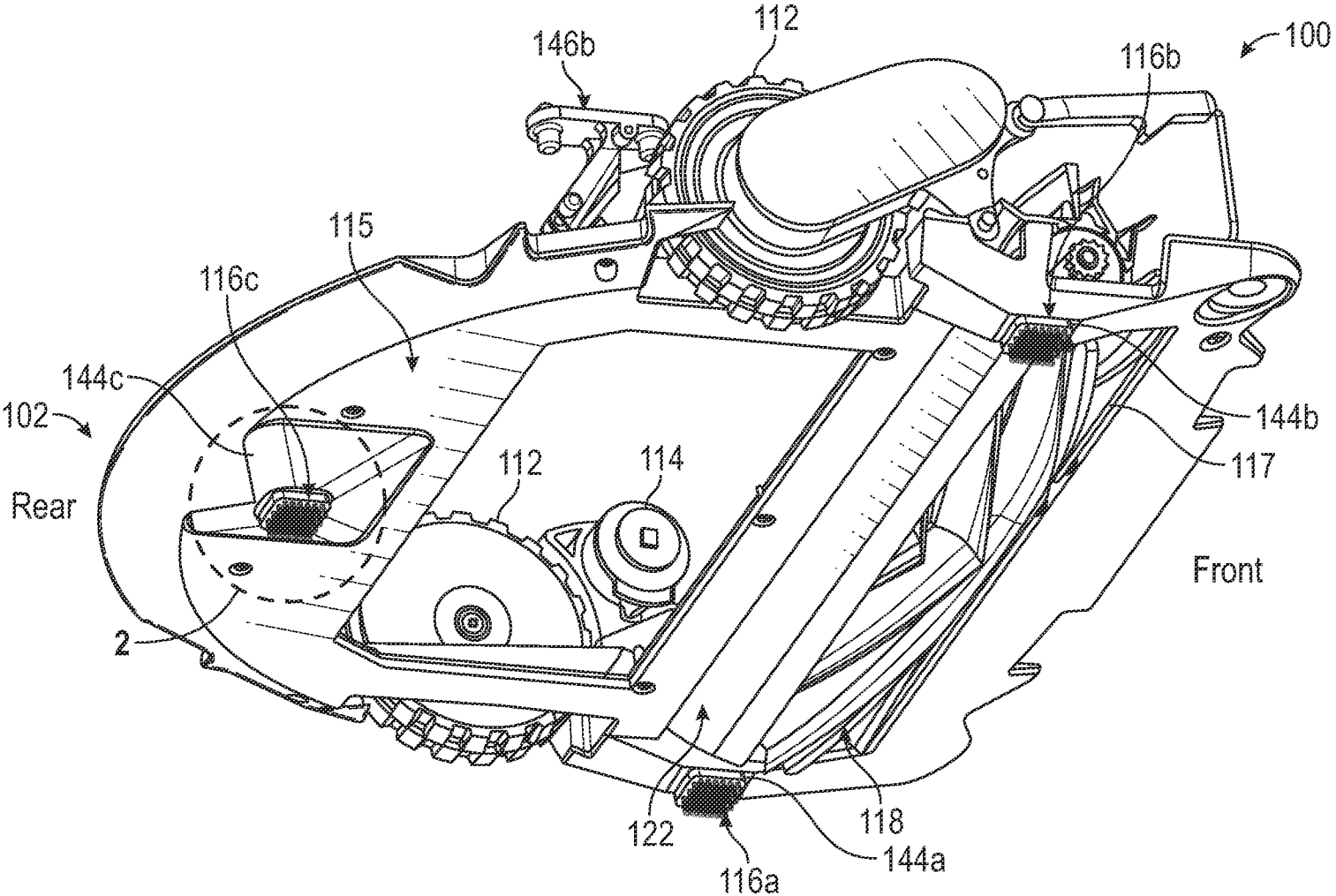
FIG. 1C illustrates a bottom isometric view of a portion of a mobile cleaning robot.

As shown in FIG. 1C, the skid plate 115 can define supports 144*a*, 144*b*, and 144*c* (collectively referred to as supports 144) for the skids 116*a*, 116*b*, and 116*c*, respectively. The supports 144 can optionally extend downward and can optionally be integrally formed with the skid plate 115, The supports can include one or more walls or projections to help position the skids at a desired location (e.g., vertically with respect to the skid plate 115 and housing 102).

Figure 2:
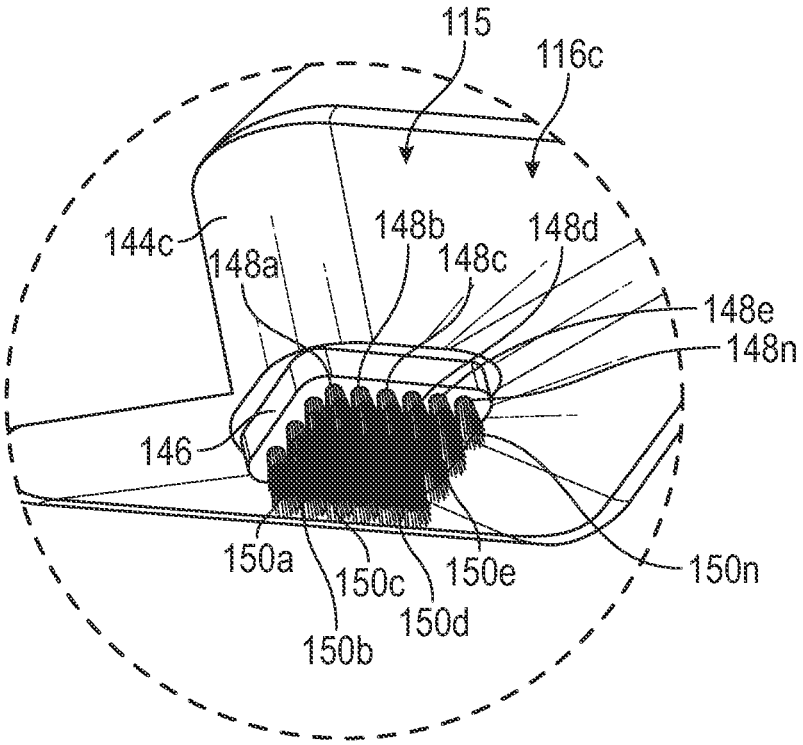
FIG. 2 illustrates an isometric view of a portion of a mobile cleaning robot.

FIG. 2 illustrates an isometric view of the skid 116*c* and the skid plate 115 of the mobile cleaning robot 100. The skid 116*c* and skid plate 115 can be consistent with FIGS. 1A-1C discussed above; FIG. 2 shows additional details of the skid 1160 and plate 115. For example, FIG. 2 shows how the support 144*c* can extend downward from the skid plate 115 and can have a shape of an inverted pyramid with four sides. The support 144*c* can have other shapes in other examples.

FIG. 2 also shows that the skid 116*c* can include a base 146 defining a plurality of bores 148*a*-148*n*. Each bore of the bores 148*a*-148*n* can be configured to support a tuft of a plurality of tufts 150*a*-150*n* such that the base 146 supports or is connected to the plurality of tufts 150*a*-150*n*. For example, the tuft bore 148*a* can support the tuft 150*a*. Each tuft 150*a*-150*n* can include one or more bristles, which can be attached to the base 146 at an upper portion of the tufts 150. A lower portion of each bristle can be free such that each bristle (and tuft 150) can be configured to move or flex with respect to the base 146. Together the tufts 150 (and the bristles thereof) can be configured to engage the floor surface to support the body 102 of the robot 100, as shown in FIG. 3 below.

As shown in FIG. 2; the skid 116 can include tufts 150 can be about 36 tufts. The skids 116*a*, 116*b*, and 116*c* can be configured to include 5, 10, 15, 20, 25, 30, 35, 40, 45, 50, 55, 60, 75, 100, or the like tufts. As shown in FIG. 2, the tufts 150 can be arranged in rows and columns with equal spacing, which can help to allow debris to shed or pass through the skids 116. As shown in FIG. 1A, the tufts 150 can be offset from each other, which can help to avoid debris from entering the skids 116.

Figure 3:
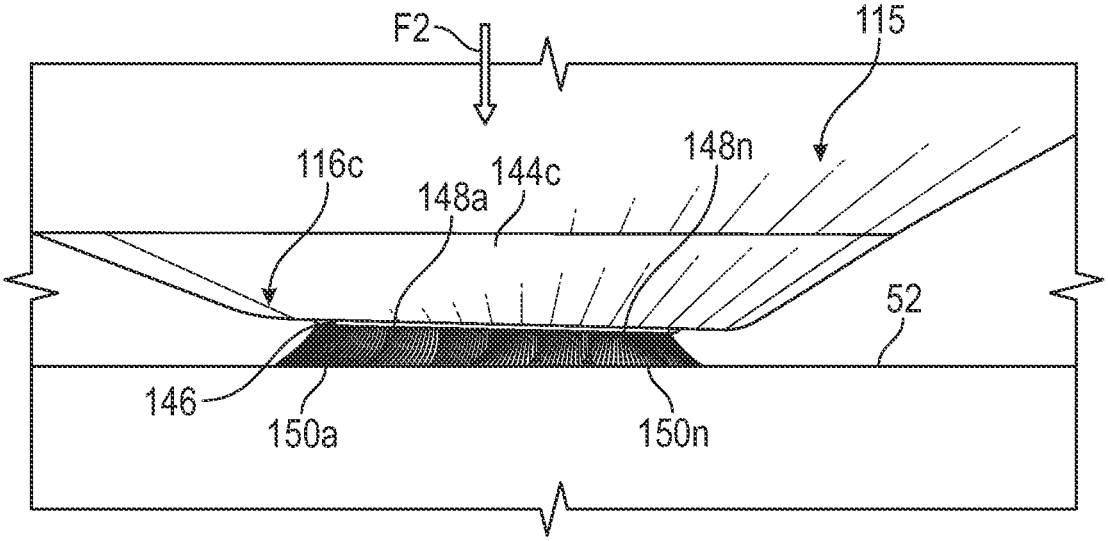
FIG. 3 illustrates a side view of a portion of a mobile cleaning robot.

FIG. 3 illustrates a side view of the skid 116*c* of the mobile cleaning robot 100. The skid 116*c* (and skid plate 115) can be consistent with FIGS. 1-2 discussed above; FIG. 3 shows the skid 116*c* in a different configuration. For example, FIG. 3 shows how the tufts 150 can flex with respect to the base 146 and the support 144*c*, helping to allow the skids 116 to traverse obstacles to mobility, such as rugs or other floor surface transitions. Flexing or deflection of the tufts 150 can be limited by contact between the base 146 and the tufts 150 to distribute the force F2, which can help to transfer load through each tuft 150 and each bristle thereof in a stable manner, and which also helps to allow the bristles of the tufts 150 to change direction along with a direction of movement of the robot 100. Together, the bristles and tufts 150 help to allow the skid 116*c* to slide without rotating.

Figure 4:
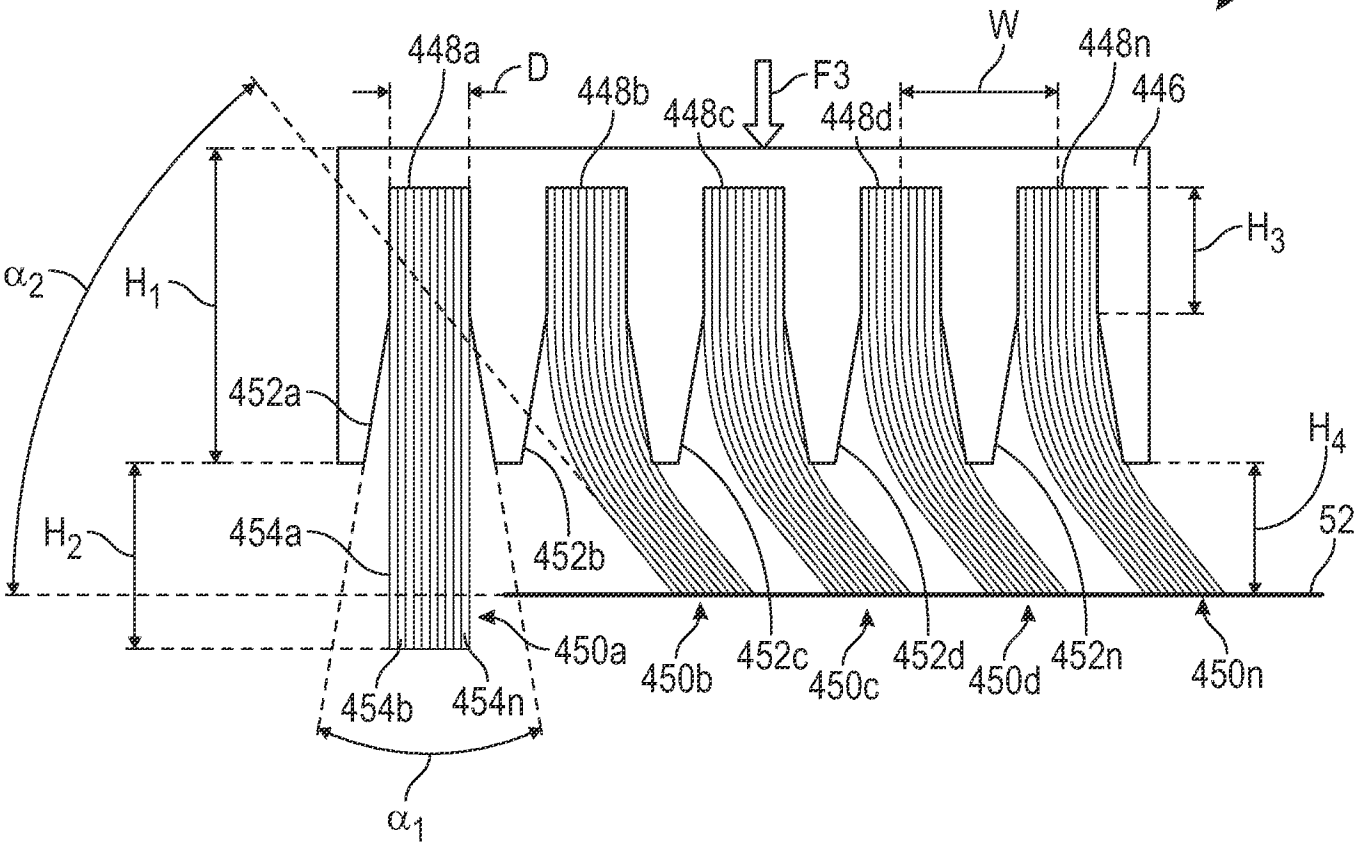
FIG. 4 illustrates a cross-sectional view of a portion of a mobile cleaning robot.

FIG. 4 illustrates a cross-sectional view of a skid 416 of a mobile cleaning robot, such as the robot 100. The skid 416 can be similar to any of the skids 116 discussed above The skid 416 can include a base 446 defining a plurality of tuft bores 448*a*-448*n* where each of the tuft bores 448*a*-448*n* can secure a tuft 450*a*-450*n*, respectively, therein.

Each tuft bore 448*a*-448*n* can be connected to a guide bore 452*a*-452*n*, respectively. The guide bores 452*a*-452*n* can be coaxial or aligned with a corresponding one of the tufts 450*a*-450*n*, respectively. The guide bores 452*a*-452*n* can each be conical or tapered outward from its respective tuft bore 448*a*-448*n*, such that the guide bores 452*a*-452*n* are each defined by an angle $\alpha 1$, which can be between 5 degrees and 35 degrees. Optionally, the angle $\alpha 1$ can be between 15 degrees and 25 degrees. Optionally, the angle $\alpha 1$ can be about 20 degrees. The angle between each tuft bore 448*a*-448*n* and its guide bore can be half of the angle $\alpha 1$, such as 10 degrees when the angle $\alpha 1$ is 20 degrees.

Each tuft bore 4548*a*-448*n* can have a diameter D between 0.5 millimeters (mm) and 3 millimeters. Optionally, the diameter D can be between 1 mm and 2 mm. Optionally, the diameter D can be about 1.5 mm. The tuft bores 448 can have a height H3 of 1 mm to 4 mm, or optionally about 2.3 mm. The tuft bores 448 can be spaced apart by width W, which can be 1 mm and 5 mm or can be about 3 mm. The base 146 can have a height H1 of between 3 mm and 9 mm, and can optionally be about 6 mm.

Each tuft 450*a*-450*n* can extend beyond the base 446 by 1 mm to 5 mm. Optionally, the tufts 450*a*-450*n* can extend beyond the base 446 by about. 3.5 mm. The tufts 450*a*-450*n* can be configured (e.g., sized and shaped) to deflect under load of the force F3 (which can be a portion of a weight of the robot (e.g., robot 100)). Optionally, the force F3 can create a pressure of between 2,000 and 20,000 Pascals (Pa) on the skids 416. Optionally, the force F3 can create between 5,000 Pa and 10,000 Pa. Optionally, the force F3 can create about 7,000 Pa (or about 1 pound per square inch). The pressure can be sufficiently low to avoid from scratching floor surfaces (as discussed below) while being sufficiently high to ensure that the tufts 450 deflect under load.

The tufts 450*a*-450*n* can be configured to engage the guide bores (or deflection bores) 452*a*-452*n*, respectively, such as to limit flexure or define a deflection of the tufts 450*a*-450*n* with respect to the floor surface 52 of an angle $\alpha 2$. The angle $\alpha 2$ can be between 20 degrees and 70 degrees. Optionally, the angle $\alpha 2$ can be between 40 degrees and 60 degrees. Optionally, the angle $\alpha 2$ can be about 50 degrees.

The length or height H3 of the tuft bores 448*a*-448*n*, the length or height of the tufts 450*a*-450*n* (H1 plus H2), the length or height 112 of the tufts 450*a*-450*n* extending beyond the base 446, and the angle $\alpha 1$ can together define the angle α2 created by engagement of the tufts 450*a*-450*n* with their respective guide bores 452*a*-452*n* when the tufts 450*a*-450*n* deflect under load of the force F3. These parameters defining the angle α2 can be selected or configured to define a desired angle α2, which can be optimized for load distribution and mobility of the robot. Such a design allows relatively soft bristles to be used, to help limit damage to floor surfaces and allows for creation of a relatively high lag angles α2, which can allow the robot to more easily traverse obstacles (such as rugs) while still being able to support adequate pressure to carry the weight of the robot (e.g., 100), but without overloading the bristles or varying the robot's ride-height. While vertical bristles can transfer load, vertical bristles may be difficult to move past obstacles such as a rug (especially a movable rug). By deflecting or loading to the angle α2, the tufts 450 can carry or transfer the portion of the load F3 of the robot (e.g., the robot 100) to the floor surface 52 while being in a position or orientation to move over obstacles, such as rugs.

The tufts 450 can include one or more bristles 454*a*-454*n*. For example, each tuft can include 1, 2, 5, 10, 15, 20, 40, 60, 80, 100 or the like bristles. Use of a large quantity of bristles can help reduce a pressure applied by each bristles, which can help to reduce probability of scratching a flooring surface when debris does become trapped by the bristles. That is, the load transferred through each bristle 454 and tuft 450 is low enough to help to avoid damaging floor surfaces should debris become trapped by the bristles 454.

The bristles can be made of one or more of polymer, metal, or the like. For example, the bristles can be made of Polytetrafluoroethylene or nylon. Use of soft and flexible bristles can help to reduce noise of operation, such as over textured floors (e.g., tile), while helping to reduce cost over other supports, such as casters. Each of the bristles can have a bristle diameter of between 0.02 mm and 0.08 mm. For example, the bristles can have a bristle diameter of 0.02 min, 0.03 mm, 0.04 mm, 0.05 mm, 0.06 mm, 0.07 mm, 0.08 mm, or the like. Use of relatively thin bristles also allows for a large quantity of bristles to be used, which can help reduce pressure applied by each bristle and can help increase skid component life.

When the tufts 450 are in a loaded position, as shown by the tufts 450*b*-450*n* in FIG. 4, the drive wheels (e.g., 112) can still be movable to travel vertically with respect to the skids 416 and the body of the robot (e.g., 100) such that the skids 416 (or 116) define the ride height of the robot with respect to the floor surface 52. That is, the drive wheels can move vertically above or below the surface 52 when the skid 416 is engaged with the surface 52, as shown in FIG. 4. When the skids are in the overload position, the ride height H4 can be between 0.5 mm and 5 mm. In some examples, the ride height can be between 2 mm and 3 mm. In some examples, the ride height H4 can be about 2.5 mm.

Figure 5:
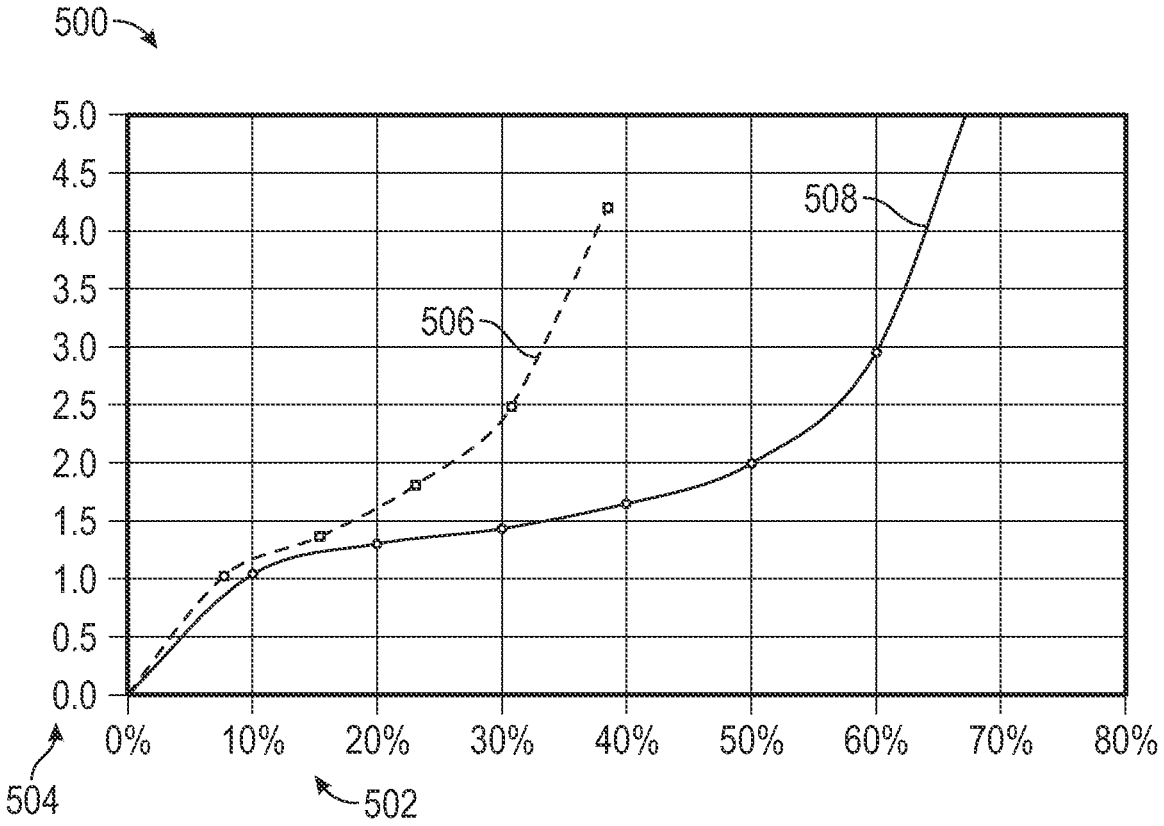
FIG. 5 illustrates a graph representing performance of components of a mobile cleaning robot.

FIG. 5 illustrates a graph 500 representing performance of components of a mobile cleaning robot. For example, skid compression as a percentage of bristle length can be on an axis 502. That is, how far the bristles or tufts of bristles deflect as a percentage of bristle length. A pressure applied to the skid can be on an axis 504. A line 506 can represent a skid including deflection or guide bores (such as the guide bores 452). A line 508 can represent a skid that does not include guide bores.

An "ideal" solution would be represented by a vertical line on the plot somewhere around the ~35% range. This is ideal because it means that the ride height of the robot is constant regardless of pressure variations, and about 35% deflection is necessary to achieve an ideal lag-angle to reduce friction over surfaces like low-pile carpets. The guide bores 452 allow softer bristles to be used than would otherwise be necessary to support a given pressure thus keeping the pressure low until the deflection approaches the desired 35% range.

As shown in the graph 500, when the pressure or load applied to the skid of the line 508 increases, deflection of the bristles increases significantly between 1.0 psi (6896 Pa) and 4.0 psi (27579), where the deflection increases from 10% to about 65%. Whereas, as shown by the line 506, when pressure applied to the skid with guide bores is increased from 1.0 psi (6896 Pa) and 4.0 psi (27579), the deflection increases from 10% to about 38%, which is significantly less deflection than in the skid without guide bores. As discussed above, the pressure applied by the skids (116 or 416) can be sufficiently low to avoid from scratching floor surfaces (as discussed below) while being sufficiently high to ensure that the tufts (150 or 450) deflect under load; however too much deflection will lower the ride height further than desired, which can cause mobility issues and can hinder cleaning performance (for example because large debris cannot move under the robot to be extracted by the roller. By using a skid (e.g., 116 or 416) that includes a guide bore (e.g., 452), as shown by the line 506, the deflection of the skid and bristles can be reduced, which helps to maintain a desired ride height while still deflecting sufficiently to traverse obstacles, such as rugs.

NOTES AND EXAMPLES

The following, non-limiting examples, detail certain aspects of the present subject matter to solve the challenges and provide the benefits discussed herein, among others.

Example 1 is a mobile cleaning robot comprising: a body; a drive wheel connected to the body and engageable with a floor surface of an environment, the drive wheel operable to move the mobile cleaning robot about an environment; and a plurality of separate skids connected to the body and engageable with the floor surface to support, together with the drive wheel, the mobile cleaning robot with respect to the floor surface.

In Example 2, the subject matter of Example 1 optionally includes wherein an individual skid of the plurality of skids includes a base and a plurality of tufts connected to the base.

In Example 3, the subject matter of Example 2 optionally includes wherein the base includes a plurality of tuft bores respectively configured to secure an individual tuft of the plurality of tufts therein.

In Example 4, the subject matter of Example 3 optionally includes wherein the base includes a guide bore extending from and aligned with a corresponding tuft bore.

In Example 5, the subject matter of any one or more of Examples 3-4 optionally include wherein an individual guide bore is tapered outwardly with respect to its corresponding tuft bore.

In Example 6, the subject matter of Example 5 optionally includes wherein the taper of the guide bore is between 5 degrees and 15 degrees from a wall of its corresponding tuft bore.

In Example 7, the subject matter of any one or more of Examples 5-6 optionally include wherein each tuft is configured to engage its respective guide bore to limit flexure of the tuft with respect to its tuft bore.

In Example 8, the subject matter of Example 7 optionally includes wherein the drive wheel is movable to travel at least in part vertically with respect to the robot, such that the plurality of skids define a ride height of the mobile cleaning robot with respect to the floor surface.

In Example 9, the subject matter of Example 8 optionally includes wherein plurality of tufts are configured to flex under load of the mobile cleaning robot to define the ride height.

In Example 10, the subject matter of Example 9 optionally wherein at least a portion of an individual tuft of the plurality of tufts is angled, when engaged with its respective guide bore, at about 50 degrees with respect to the floor surface or an underside of the body.

In Example 11, the subject matter of any one or more of Examples 8-10 optionally include wherein an individual tuft of the plurality of tufts includes a plurality of bristles.

In Example 12, the subject matter of Example 11 optionally includes wherein the ride height is defined by engagement between the plurality of skids and the floor surface, and wherein the drive wheel is movable with respect to the plurality of skids and the floor surface when the plurality of skids are engaged with the floor surface.

In Example 13, the subject matter of any one or more of Examples 1-12 optionally include wherein the each of the skids is configured to slide without rotating.

In Example 14, the subject matter of any one or more of Examples 1-13 optionally include wherein the plurality of skids includes a first skid, a second skid, and a third skid spaced apart from each other.

In Example 15, the subject matter of Example 14 optionally includes wherein the first skid and the second skid are located toward opposing ends of a cleaning head of the mobile cleaning robot, and wherein the third skid is located at a rear portion of the body.

In Example 16, the subject matter of Example 15 optionally includes a first side brush located on a first side of the cleaning head forward of the first skid; and a second side brush located on a second side of the cleaning head forward of the second skid.

Example 17 is a mobile cleaning robot comprising: a body; a pair of drive wheels connected to the body and engageable with a floor surface of an environment, the drive wheels operable to move the mobile cleaning robot about an environment; and a first skid, a second skid, and a third skid respectively coupled to the body and spaced apart from each other, each skid engageable with the floor surface to support, together with the drive wheels, the mobile cleaning robot.

In Example 18, the subject matter of Example 17 optionally includes wherein the first skid includes a base and a plurality of tufts connected to the base.

In Example 19, the subject matter of Example 18 optionally includes wherein the base includes a plurality of tuft bores respectively configured to secure an individual tuft of the plurality of tufts therein.

In Example 20, the subject matter of Example 19 optionally includes wherein the base includes a guide bore extending from and aligned with a corresponding tuft bore.

In Example 21, the subject matter of any one or more of Examples 19-20 optionally include wherein an individual guide bore is tapered outwardly with respect to its corresponding tuft bore.

In Example 22, the subject matter of Example 21 optionally includes wherein the taper of the guide bore is between 5 degrees and 15 degrees from a wall of its corresponding tuft bore.

In Example 23, the subject matter of any one or more of Examples 21-22 optionally include wherein each tuft is configured to engage its respective guide bore to limit flexure of the tuft with respect to its tuft bore.

In Example 24, the subject matter of Example 23 optionally includes wherein the drive wheel is movable to travel at least in part vertically with respect to the robot, such that the plurality of skids define a ride height of the mobile cleaning robot with respect to the floor surface.

In Example 25, the subject matter of Example 24 optionally includes wherein plurality of tufts are configured to flex under load of the mobile cleaning robot to define the ride height.

In Example 26, the subject matter of Example 25 optionally includes wherein at least a portion of an individual tuft of the plurality of tufts is angled, when engaged with its respective guide bore, at about 50 degrees with respect to the floor surface or an underside of the body.

Example 27 is a mobile cleaning robot comprising: a body; a cleaning head connected to the body and operable to extract debris from a floor surface of an environment; a pair of drive wheels connected to the body and engageable with a floor surface of an environment, the drive wheels operable to move the mobile cleaning robot about the environment; a first skid and a second skid each connected to the body on opposing sides outward of the cleaning head; and a third skid connected to a rear portion of the body, the first skid, the second skid, and the third skid engageable with the floor surface to engage a floor surface to define a ride height of the mobile cleaning robot.

Example 28 is a mobile cleaning robot comprising: a body; a cleaning head connected to the body and operable to extract debris from a floor surface of an environment; a drive wheel connected to the body and engageable with a floor surface of an environment, the drive wheel operable to move the mobile cleaning robot about an environment; and one or more tufted or bristled skids connected to the body, separate and spaced apart from the cleaning head, and engageable with the floor surface by sliding, without rotating, to support, together with the drive wheel, the mobile cleaning robot with respect to the floor surface.

In Example 29, the apparatuses or method of any one or any combination of Examples 1-28 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any, combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:

a body including a bottom plate;

a drive wheel connected to the body and engageable with a floor surface of an environment, the drive wheel operable to move the mobile cleaning robot about the environment, the drive wheel movable to travel at least in part vertically with respect to the robot; and a plurality of separate skids connected to and extending from the bottom plate of the body and engageable with the floor surface to support, together with the drive wheel, the mobile cleaning robot with respect to the floor surface, such that the plurality of skids together solely define a ride height of the mobile cleaning robot with respect to the floor surface;

wherein one skid of the plurality of separate skids is located forward of the drive wheel and another skid of the plurality of separate skids is located rearward of the drive wheel; and wherein each of the one skid and the other skid comprises a base and a plurality of tufts connected to the base.

2. The mobile cleaning robot of claim 1, wherein each base is connected to or formed as part of the bottom plate of the body.

3. The mobile cleaning robot of claim 2, wherein each base includes a plurality of straight tuft bores respectively configured to secure an individual tuft of the plurality of tufts therein.

4. The mobile cleaning robot of claim 3, wherein each base includes a guide bore extending from and aligned with a corresponding tuft bore.

5. The mobile cleaning robot of claim 3, wherein an individual guide bore is tapered outwardly with respect to a corresponding straight tuft bore.

6. The mobile cleaning robot of claim 5, wherein the taper of the guide bore is between 5 degrees and 15 degrees from a wall of the corresponding tuft bore.

7. The mobile cleaning robot of claim 5, wherein each tuft is configured to engage each respective guide bore to limit flexure of the tuft with respect to the tuft bore.

8. The mobile cleaning robot of claim 7, wherein the plurality of tufts are configured to flex under load of the mobile cleaning robot to define the ride height.

9. The mobile cleaning robot of claim 8, wherein at least a portion of an individual tuft of the plurality of tufts is angled, when engaged with a respective guide bore, at about 50 degrees with respect to the floor surface or an underside of the body.

10. The mobile cleaning robot of claim 9, wherein the individual tuft of the plurality of tufts includes a plurality of bristles.

11. The mobile cleaning robot of claim 10, wherein the ride height is defined by engagement between the plurality of skids and the floor surface, and wherein the drive wheel is movable with respect to the plurality of skids and the floor surface when the plurality of skids are engaged with the floor surface.

12. The mobile cleaning robot of claim 1, wherein each of the plurality of skids is configured to slide without rotating.

13. The mobile cleaning robot of claim 1, wherein the one skid is a first skid, the other skid is a third skid, and the plurality of skids further includes a second skid, wherein the first skid, the second skid, and third skids are spaced apart from each other.

14. The mobile cleaning robot of claim 13, wherein the first skid and the second skid are located toward opposing ends of a cleaning head of the mobile cleaning robot, and wherein the third skid is located at a rear portion of the body.

15. The mobile cleaning robot of claim 14, further comprising:

a first side brush located on a first side of the cleaning head forward of the first skid; and a second side brush located on a second side of the cleaning head forward of the second skid.

16. A mobile cleaning robot comprising:

a body including a bottom plate;

a pair of drive wheels connected to the body and engageable with a floor surface of an environment, the drive wheels operable to move the mobile cleaning robot about the environment, the pair of drive wheels movable to travel at least in part vertically with respect to the robot; and a first skid, a second skid, and a third skid respectively fixedly coupled to the bottom plate of the body and spaced apart from each other, each skid engageable with the floor surface to support, together with the drive wheels, the mobile cleaning robot, such that the first skid, the second skid, and the third skid together define a ride height of the mobile cleaning robot with respect to the floor surface;

wherein the first skid and the second skid are located forward of the pair of drive wheels and the third skid is located rearward of the pair of drive wheels; and wherein each of the first skid, second skid and third skid comprise a base and a plurality of tufts connected to the base.

17. The mobile cleaning robot of claim 16, wherein each of the bases includes a plurality of tuft bores respectively configured to secure an individual tuft of the plurality of tufts therein.

18. The mobile cleaning robot of claim 17, wherein each of the bases includes a guide bore extending from and aligned with a corresponding tuft bore.

19. The mobile cleaning robot of claim 17, wherein an individual guide bore is tapered outwardly with respect to a corresponding tuft bore.

20. The mobile cleaning robot of claim 19, wherein the taper of the guide bore is between 5 degrees and 15 degrees from a wall of the corresponding tuft bore.

21. The mobile cleaning robot of claim 19, wherein each tuft is configured to engage each respective guide bore to limit flexure of the tuft with respect to the corresponding tuft bore.

22. The mobile cleaning robot of claim 21, wherein the plurality of tufts are configured to flex under load of the mobile cleaning robot to define the ride height.

23. The mobile cleaning robot of claim 22, wherein at least a portion of an individual tuft of the plurality of tufts is angled, when engaged with its respective guide bore, at about 50 degrees with respect to the floor surface or an underside of the body.

* * * * *